US006702287B1

(12) United States Patent
Pendexter

(10) Patent No.: US 6,702,287 B1
(45) Date of Patent: Mar. 9, 2004

(54) METHOD OF PLAYING AN ADVANCED CHESS GAME

(75) Inventor: Lee Pendexter, 106 Alicia Dr., Taunton, MA (US) 02780

(73) Assignee: Lee Pendexter, Taunton, MA (US)

( * ) Notice: Subject to any disclaimer, the term of this patent is extended or adjusted under 35 U.S.C. 154(b) by 0 days.

(21) Appl. No.: 10/341,002

(22) Filed: Jan. 13, 2003

(51) Int. Cl.[7] ..... A63F 3/00
(52) U.S. Cl. ..... 273/261; D21/349
(58) Field of Search ..... 273/260, 261, 273/262; D21/334, 348, 349

(56) References Cited

U.S. PATENT DOCUMENTS 4,778,187 A * 10/1988 Deak, Jr. ..... 273/261
4,932,669 A * 6/1990 Perry ..... 273/261
5,125,666 A * 6/1992 Adams ..... 273/261
5,749,583 A * 5/1998 Sadounichvili et al. ..... 273/261

* cited by examiner

*Primary Examiner*—Vishu K. Mendiratta

(57) ABSTRACT

A method of playing a modified advanced chess game called Super Chess which provides a board having alternating dark and light squares arrayed in a ten-row by eleven-column configuration. The sixteen pieces of the orthodox chess are all provided in each color with the exception of the king being replaced by a super king and the addition of a ninth, tenth, and eleventh pawn and fifteen new super pieces: two super rooks, two super knights, two super bishops, two phantoms, one super queen, one monster piece, super king and four super pawns, all fifteen super pieces having new and unique movements and abilities.

2 Claims, 17 Drawing Sheets

| | | | | | | | | | | | |
|---|---|---|---|---|---|---|---|---|---|---|---|
| SR | SB | SN | PH | SQ | SK | M | PH | SB | SN | SR | 10 |
| SP | SP | R | B | N | Q | B | N | R | SP | SP | 9 |
| P | P | P | P | P | P | P | P | P | P | P | 8 |
| | | | | | | | | | | | 7 |
| | | | | | | | | | | | 6 |
| | | | | | | | | | | | 5 |
| | | | | | | | | | | | 4 |
| P | P | P | P | P | P | P | P | P | P | P | 3 |
| SP | SP | R | B | N | Q | B | N | R | SP | SP | 2 |
| SR | SB | SN | PH | SQ | SK | M | PH | SB | SN | SR | 1 |
| A | B | C | D | E | F | G | H | I | J | K | |

Figure 1

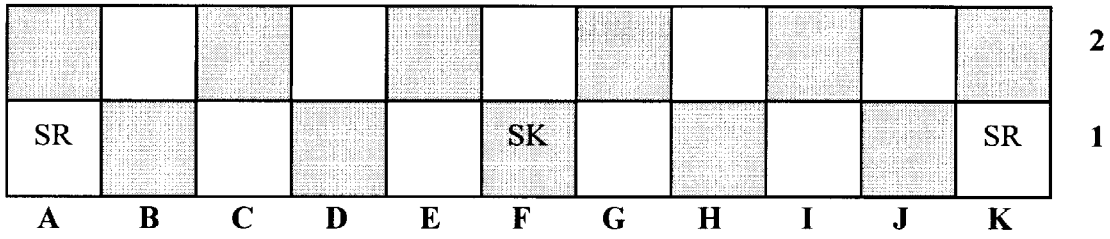
Original positioning before castling. (White) Figure 13
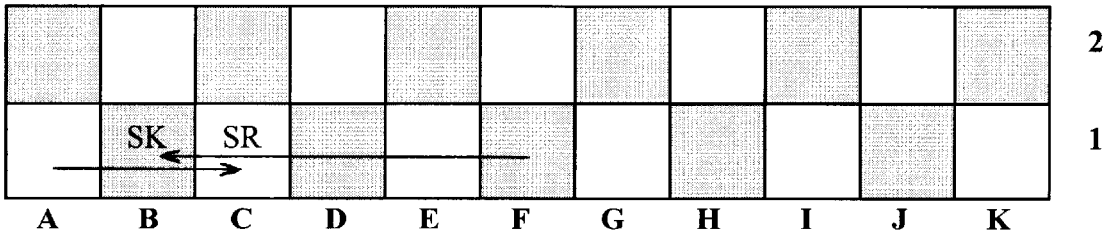
Position after castling to the left side. (White) Figure 14
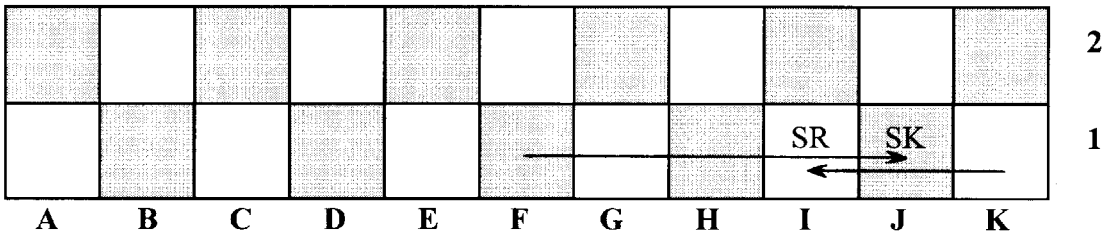
Position after castling to the right side. (White) Figure 15

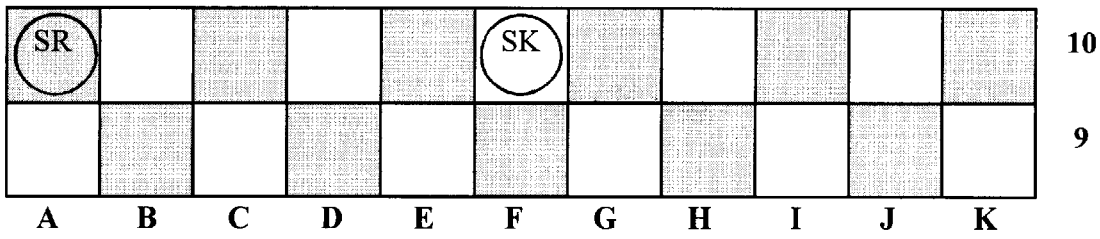
Original positioning before castling. (Black) Figure 16
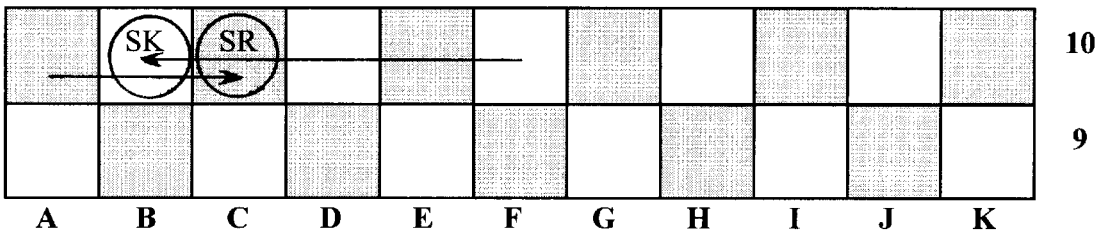
Position after castling to the left side. (Black) Figure 17
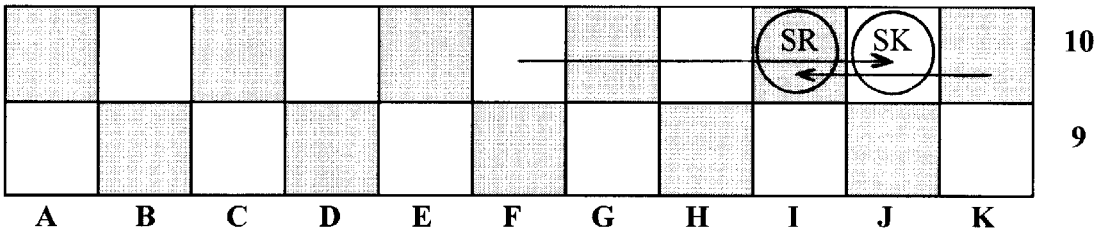
Position after castling to the right side. (Black) Figure 18

METHOD OF PLAYING AN ADVANCED CHESS GAME

BACKGROUND OF THE INVENTION

1. Field

This invention relates to board games and more particularly to a modified, advanced chess game.

2. State of the Art

The standard game of chess is well known and is believed by many accomplished players to be excessively known, its possibilities too well understood and predictable, not surprisingly there have been a number of attempts to improve upon the game of chess.

U.S. Pat. No. 5,735,523, issued to Patrick D. C. Fioriglio in 1998 is one example of a chess improvement having a board that is eight spaces deep and ten spaces wide. Two new pieces "earls," are introduced each originally lined up between the bishop and knight prior to play each earl is moved two spaces in a first diagonal direction, and the one space in a second diagonal direction.

U.S. Pat. No. 5,690,334, issued to George William Duke in 1997 discloses an eight by ten board with two new "falcon" pieces. While the falcon pieces cannot jump over other pieces, in other manners tend to exhibit considerable freedom of movement.

U.S. Pat. No. 6,095,523, which has a ten by ten board with two new "dragon pieces" and four special dragon squares.

Other U.S. Pat. Nos., such as 5,421,582, 4,778,187 and 3,652,091 are introducing still further variations, such as facilities enabling the participation of third and fourth players.

While much innovation has been directed to chess improvement, few of these games have gained considerable acclaim or popularity. A need definitely exists for an advanced chess game to challenge a large number of expert aficionados of the game, and to reclaim the original games unexpectedness or spontaneity wherein many strategies are still unexplored. While still preserving the spirit and most essential dynamics of the original while it multiplies the possibilities of game positions in a unique way.

BRIEF SUMMARY OF THE INVENTION

The present invention is a creation of an advanced chess game played upon a game board with eleven files and ten ranks both sides have thirty-three pieces eighteen orthodox pieces and fifteen pieces that have new and unique movement.

OBJECTS AND ADVANTAGES

Accordingly, several objects and advantages of the present invention are:

(A) to create an expanded chess like game on a larger board with new pieces capable of a unique mode of movement that compliments the orthodox pieces.

(B) to expand the board to the eleven by ten board size, to multiply the amount of game positions and play possibilities.

(C) to introduce a new powerful "monster" piece that can move into any of the squares in any of the four, three by three square blocks directly diagonally to it and has the unique feature of being able to take two pieces in one move, and can jump any piece.

(D) to introduce the "phantom" piece that can move four squares in any direction, can jump off one side of the board and come back on the opposite side to finish its move and can also jump any piece.

(E) to introduce the super pawn which can promote to any piece and move vertically any amount of squares on one move, or horizontally any amount of squares on one move, but cannot jump pieces or move backwards, and can only take diagonally one square.

(F) to introduce the super knight which can move two squares horizontally and one square vertically, or two squares vertically and one square horizontally, or three squares horizontally and two squares vertically, or three squares vertically and two squares horizontally.

(G) to introduce the super bishop which can ricochet off the side once and continue its move and has the ability to jump its own pieces.

(H) to introduce the super rook which can jump its own pieces.

(I) to introduce the super queen which has the combined moves of the super rook and super bishop.

(J) to introduce the super king which has the ability to move one or two squares in one move.

(K) to disclose an improved variant of chess with new pieces that have forking variations unmatched by any orthodox piece.

(L) further objects and advantages of my invention will become apparent from a consideration of the drawings and ensuing descriptions.

DRAWINGS

I have used letters to signify the pieces because the appearance of the pieces is not important, it is only necessary that the pieces be readily distinguishable from each other.

Reference Letters In Drawings

| | | | |
|---|---|---|---|
| SK | White super king | SK | Black super king |
| SQ | White super queen | SQ | Black super queen |
| M | White monster | M | Black monster |
| P | White phantom | P | Black phantom |
| SR | White super rook | SR | Black super rook |
| SB | White super bishop | SB | Black super bishop |
| SN | White super knight | SN | Black super knight |
| SP | White super pawn | SP | Black super pawn |
| P | White orthodox pawn | P | Black orthodox pawn |
| Q | White orthodox queen | Q | Black orthodox queen |
| R | White orthodox rook | R | Black orthodox rook |
| N | White orthodox knight | N | Black orthodox knight |
| B | White orthodox bishop | B | Black orthodox bishop |

Reference letters that are encircled represent black pieces.

X—represents the square to which the piece in these drawings can move.

An X or piece (reference letter) that is underlined represents that the piece that is on that square is being taken.

Arrows represent where a piece moves, with the arrowhead representing the square said moving piece stops on.

FIG. 1 is a view of the new, expanded chess game showing the initial position of the game board with the Black pieces at the top and the white pieces at the bottom.

FIGS. 13 thru 15 is a representation of the castling move for the white super king, the super king on F1 moves to either J1 and the rook moves on the other side to I1 or the super king moves to B1 and the rook moves to C1.

FIGS. 16 thru 18 is a representation of the castling move for the black super king wherein the super king can either move from F10 to J10 with the super rook at k10 moving to i10 or said super king can move to B10 and the super rook at A10 moves to C10.

Figure 19:
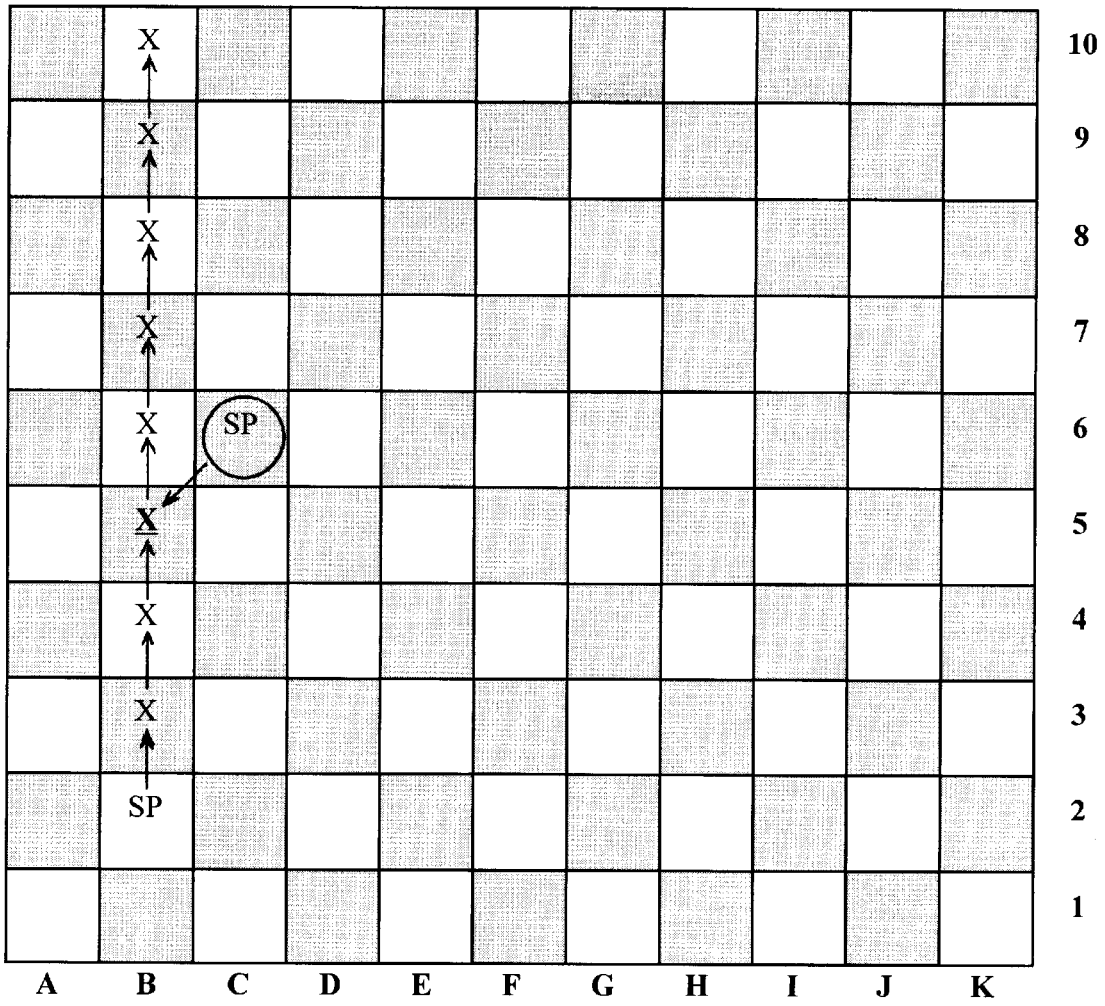

FIG. 19 represents a demonstration of the en passant move between the super pawn at B2 and the super pawn on C6 where said C6 super pawn takes said B2 super pawn by moving to B5.

Figure 20:
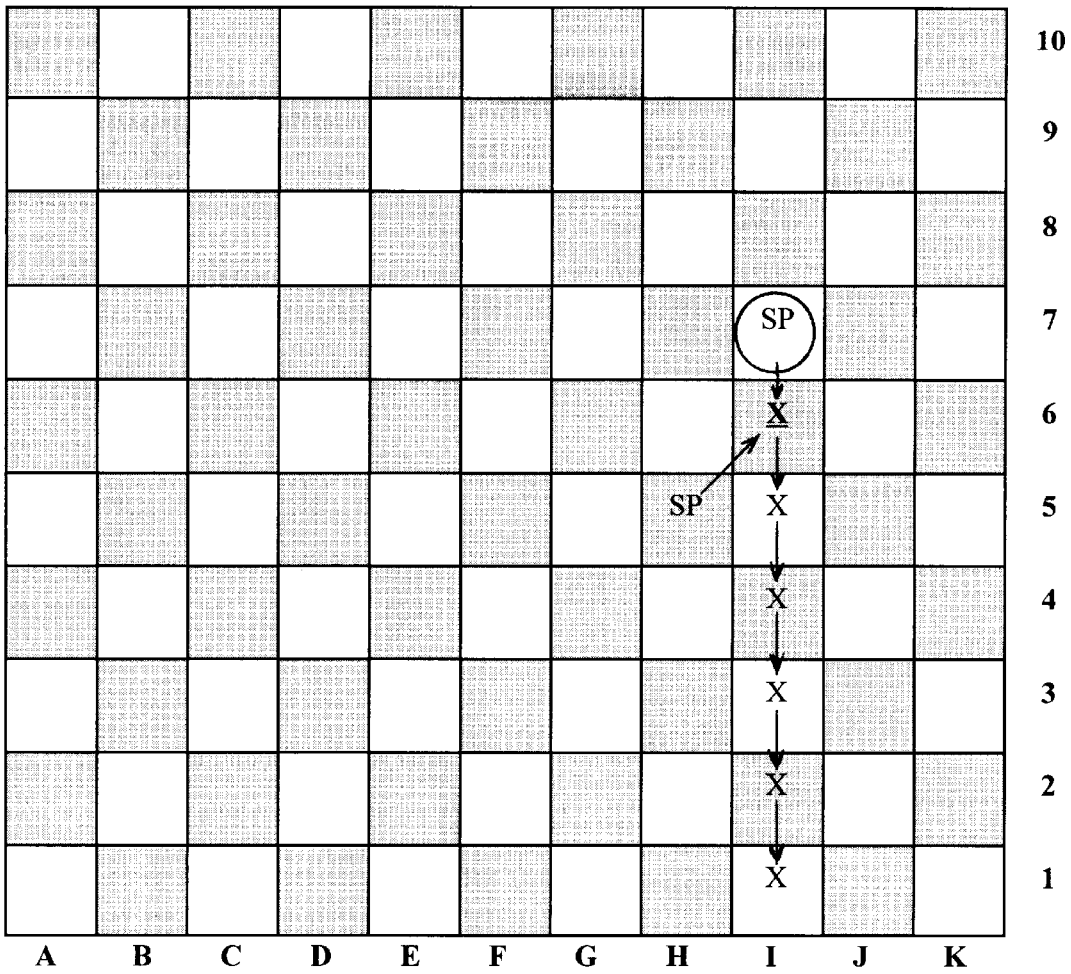

FIG. 20 represents the en passant move between two super pawns wherein a white super pawn at H5 takes a black super pawn at I6.

Figure 21:
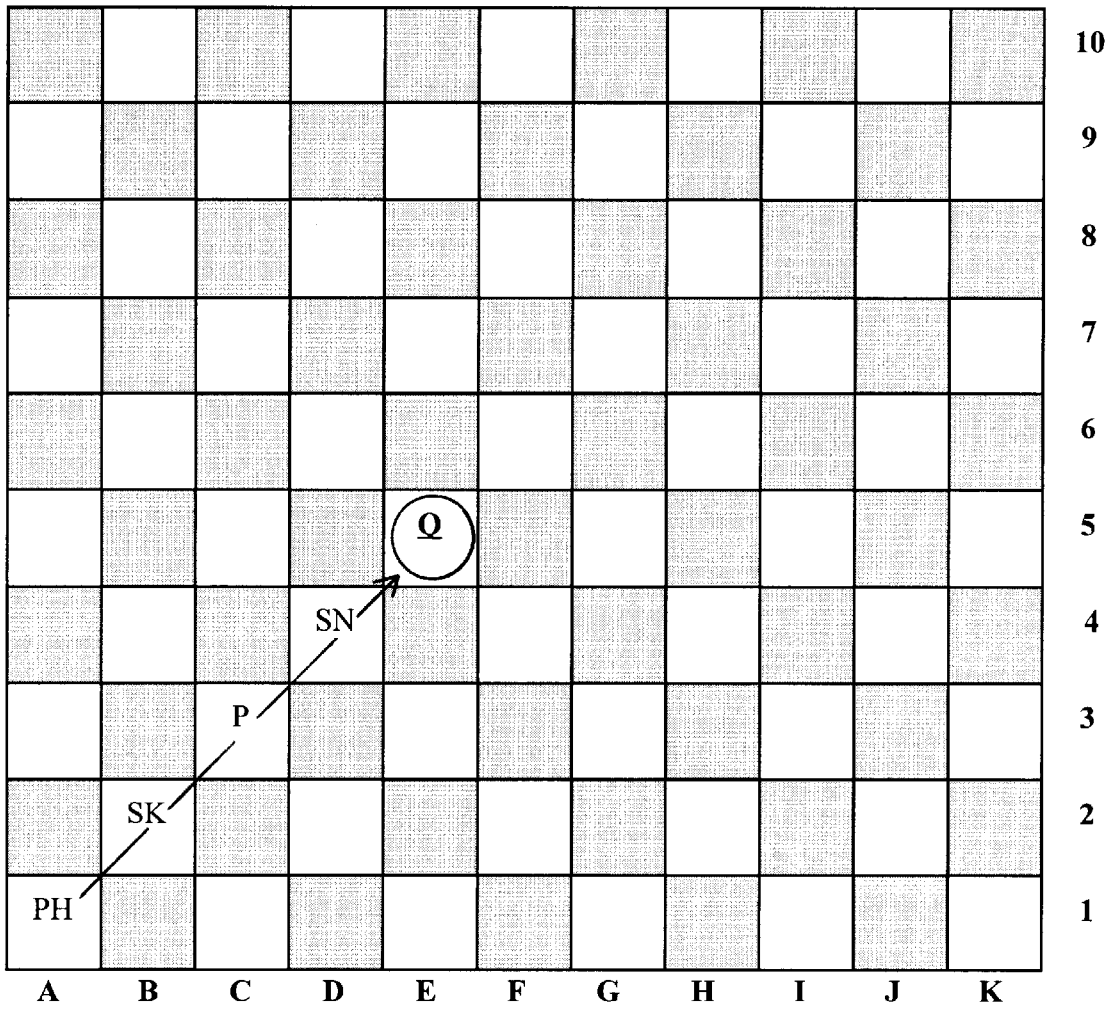

FIG. 21 represents a demonstration of the phantom piece jumping three pieces diagonally and taking a black queen at E5.

DESCRIPTION

Referring in generally to FIGS. 1 thru 21 a method of playing a modified chess game in accordance with the rules of the invention is seen. The game board provides alternating dark squares and white squares arrayed in a ten row by eleven column configuration, with the exception of the king, all orthodox pieces are provided in each color with the addition of a ninth, tenth, and eleventh pawns and fifteen new super pieces: two super rooks, two super bishops, two super knights, two phantoms, one super queen, one super king, one monster, and four super pawns.

In general the rules of orthodox chess apply to this invention except as otherwise noted. The moves of orthodox chess are well known and are generally outlined in U.S. Pat. Nos. 5,735,523 and 5,690,334 which are hereby incorporated in their entirety by reference.

As seen in FIG. 1 a preferred version of the game board includes a total of one hundred and ten squares alternating light and dark colors arrayed in ten rows and eleven columns. Wherein each row includes eleven squares and each column includes ten squares as seen in FIG. 1.

As stated earlier both opposing sides light and dark pieces include two orthodox rooks, two orthodox knights, two orthodox bishops, one orthodox queen, and eleven orthodox pawns. These pieces move in the same manner allowed in orthodox chess, although due to the increased size of the board, the distance moved may sometimes be greater.

As seen in FIGS. 13 thru 18, the preferred embodiment of the invention, the super king may castle to either side by moving four spaces toward either super rook. The super rook toward which the super king moves is then moved to the square on the opposite side of the super king from where the super rook started. Castling may only take place if the super rook and the super king that participate in the castling have not moved and there are no pieces between the super king and the super rook.

As seen in FIG. 1, eleven orthodox pawns are provided for each color at the start of the game. The white side includes eleven orthodox pawns, one orthodox pawn initially located on each square in the third row. The black side includes eleven orthodox pawns, one pawn initially located on each square in the eighth row.

As seen in FIG. 1, each color is provided with four super pawns. The white side includes four super pawns initially located on the second row at A2, B2, J2 and K2.

The super pawn has similar movement of the orthodox pawns, for example they take another piece by moving to that pieces square one move diagonally and said orthodox pawn and said super pawn may promote to another piece when they move to the tenth row but said orthodox pawn can only promote to an orthodox piece while said super pawn can promote to any piece, except the super king.

Figure 10:
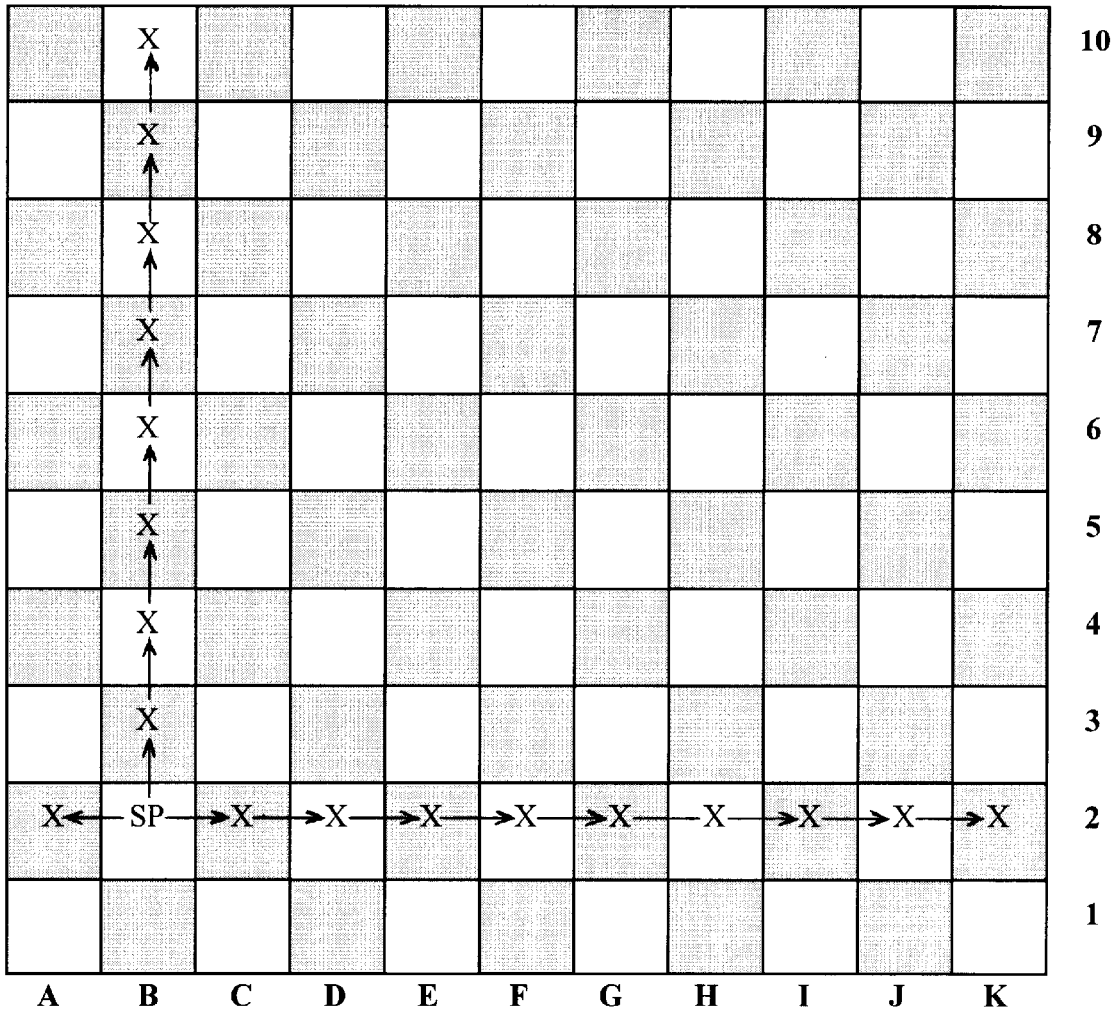
FIG. 10 is a representation of the movement pattern of the super pawn upon a portion of the expanded game board.
Figure 11:
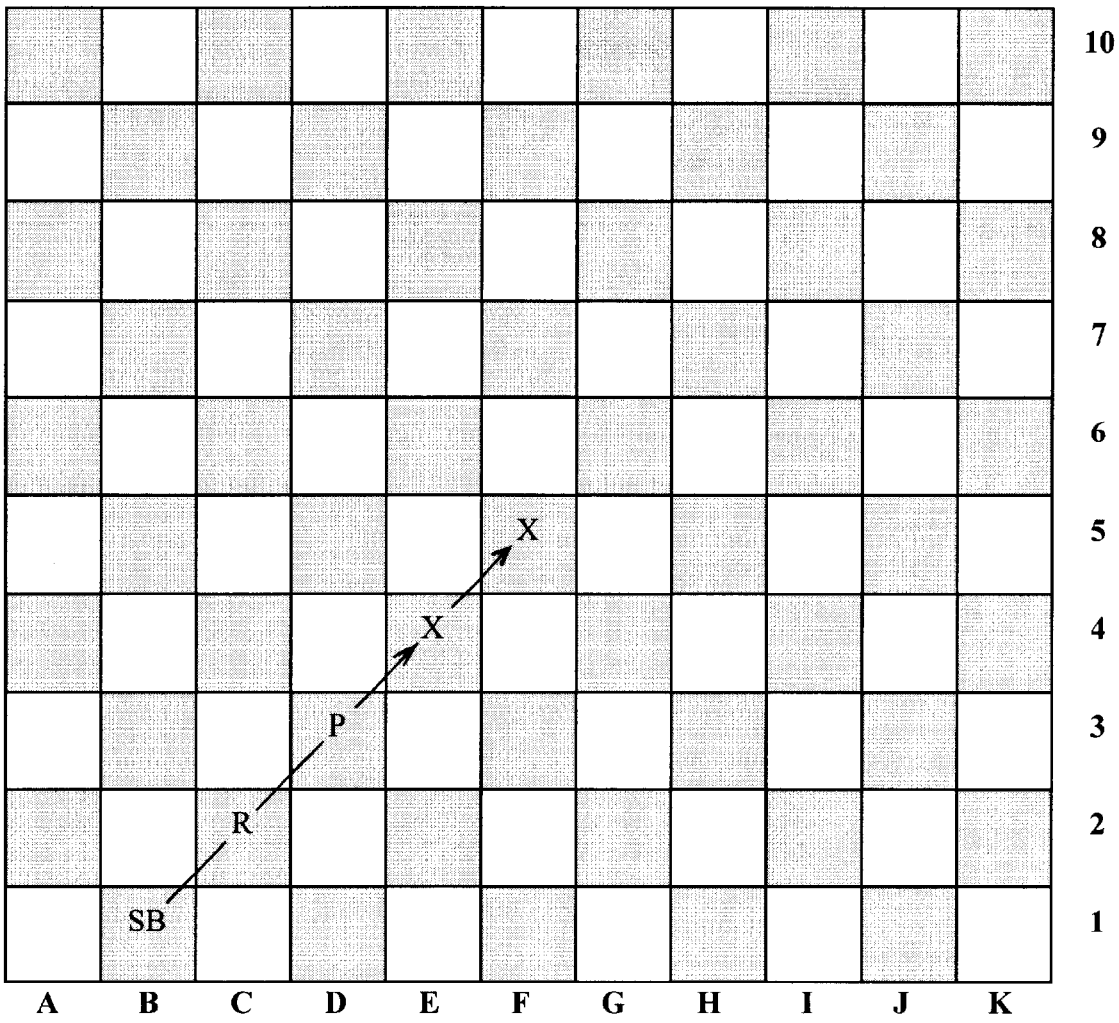
FIG. 11 is a representation of the super bishop jumping two pieces upon a portion of the expanded game board.
Figure 12:
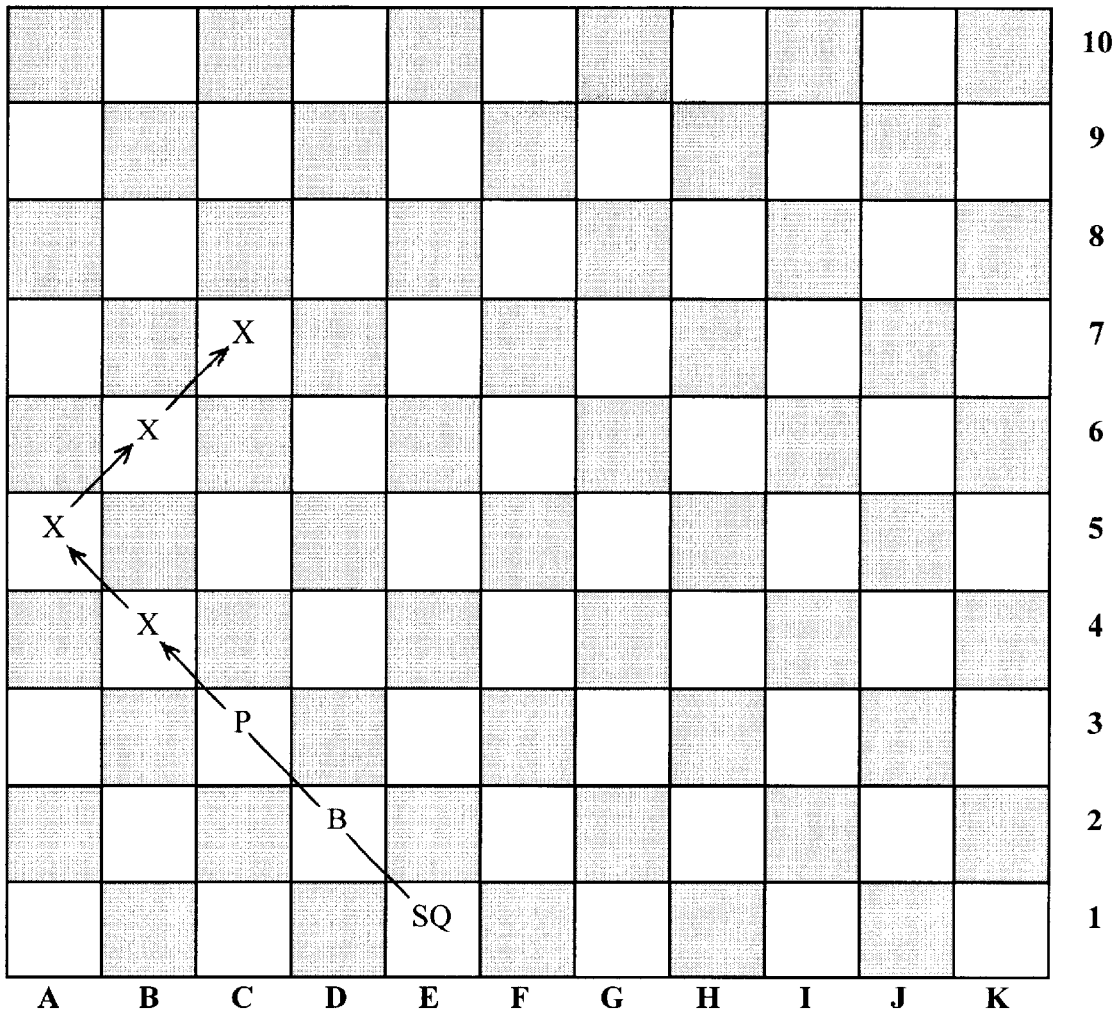
FIG. 12 is a representation of the super queen jumping two pieces upon a portion of the expanded game board.

As seen in FIG. 10, the super pawn can move any amount of squares horizontally or vertically, but cannot move backwards or jump other pieces.

As seen in FIGS. 19 and 20, the super pawn can make an en passant move similarly to said orthodox pawn. But the super pawn can only make said maneuver against another super pawn and said orthodox pawn can only make en passant moves against another orthodox pawn.

As seen in FIGS. 19 and 20, the super pawn can make the en passant move anywhere on the board that another super pawn passes said super pawn without stopping to directly challenge it diagonally.

As seen in FIG. 1, each color is provided with two super rooks. The white side includes two super rooks initially located at squares A1 and K1. The black side includes two super rooks initially located at squares A10 and K10.

Figure 7:
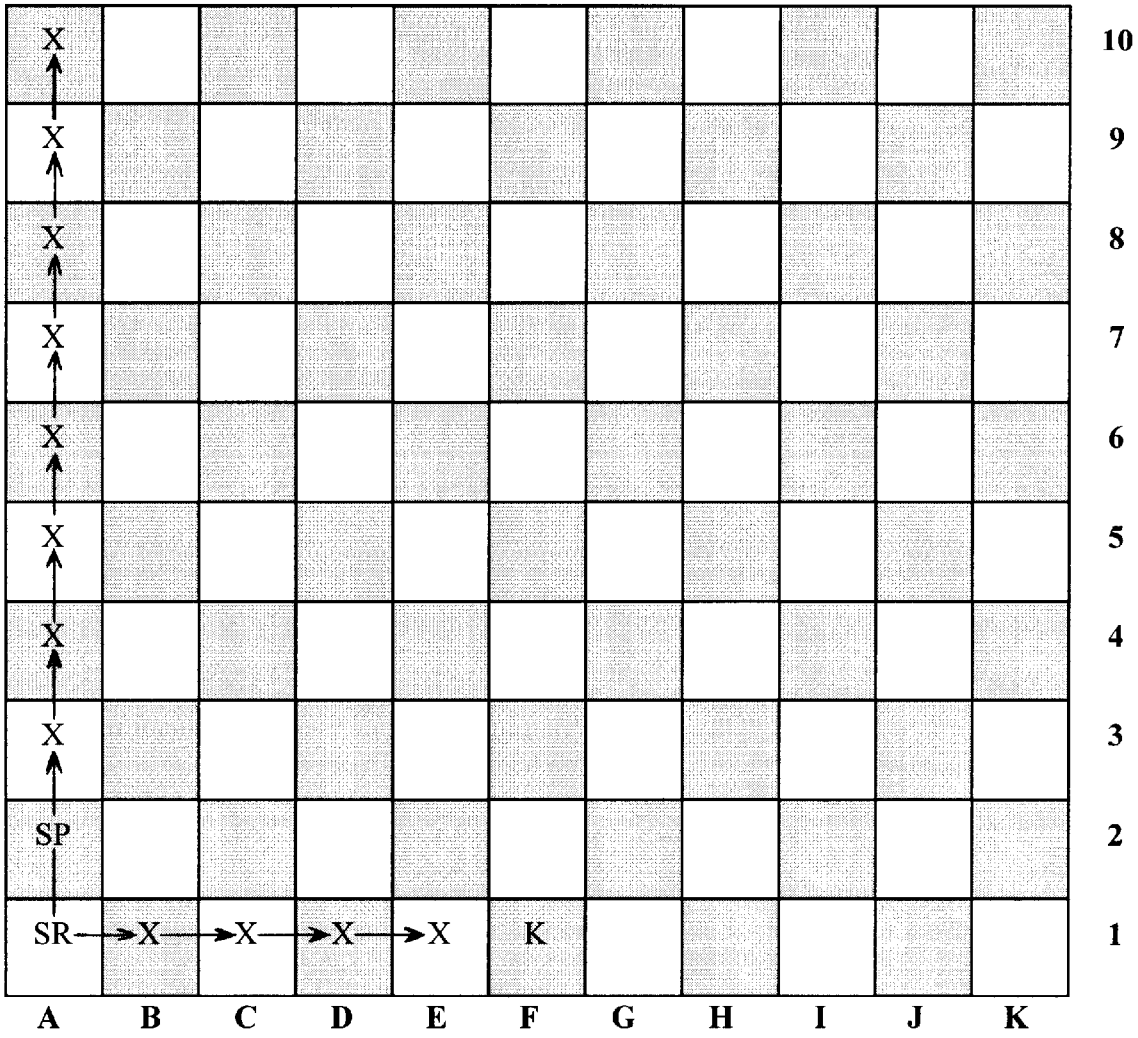
FIG. 7 is a representation of the movement pattern of the super rook upon a portion of the expanded game board also demonstrating the jumping movement of said piece over another piece.

As seen in FIG. 7, the super rooks have the same movement as orthodox rooks with the exception that said super rooks may jump all of their own pieces except the super king which they may only jump during a castling move.

As seen in FIG. 1, each color is provided with two super knights. The white side includes two super knights initially located at squares C1 and J1. The black side includes two super knights initially located at squares C10 and J10.

Figure 9:
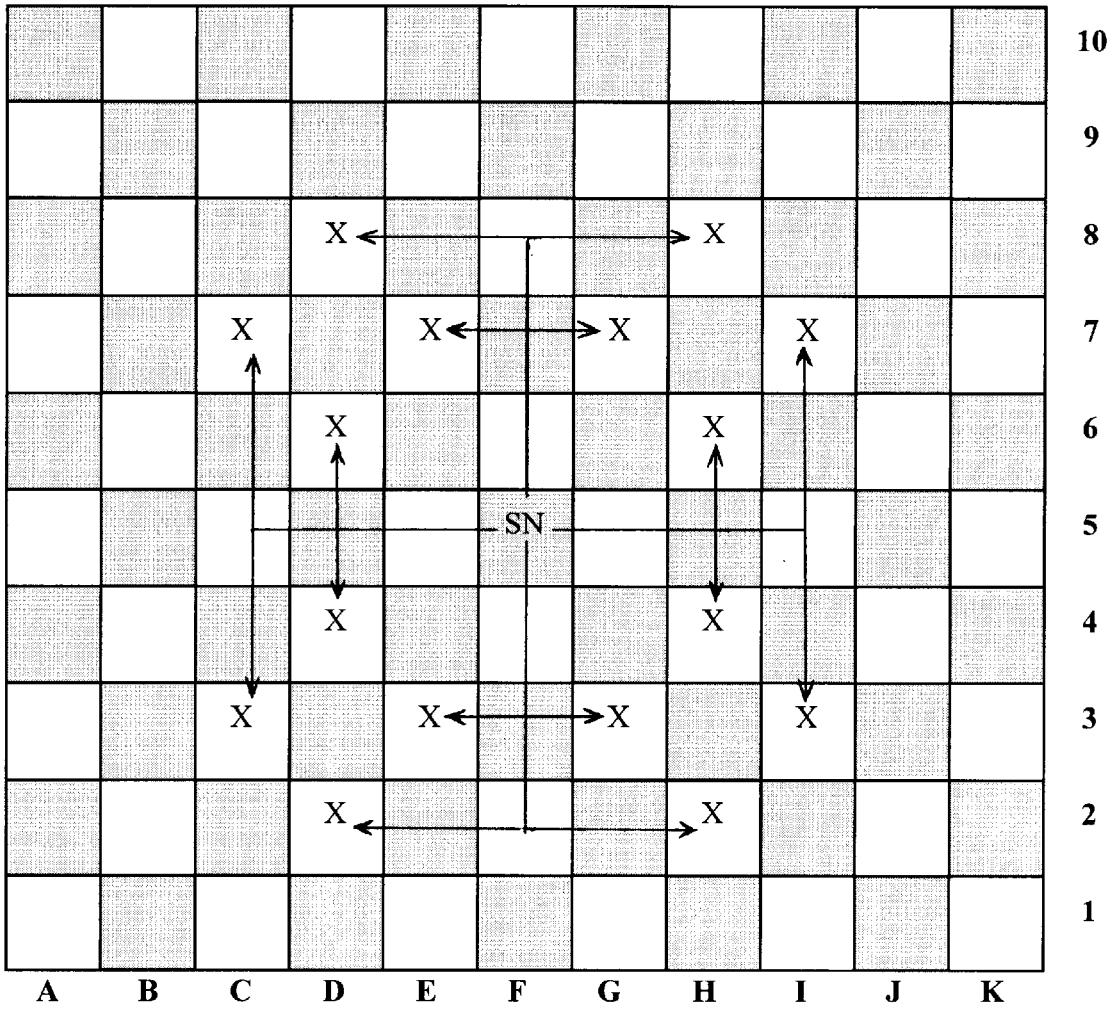
FIG. 9 is a representation of the movement pattern of the super knight upon a portion of the expanded game board.

As seen in FIG. 9, said super knights have the same movement as orthodox knights but additionally have the ability to move to a square three squares in either horizontal direction and two squares in either vertical direction. And said super knight may also move to a square three squares in either vertical direction and two squares in either horizontal direction.

As seen in FIG. 1, each color is provided with two super bishops. The white side includes two super bishops initially located on the first row at B1 and I1. The black side includes two super bishops initially located on the tenth row at B10 and I10.

Figure 8:
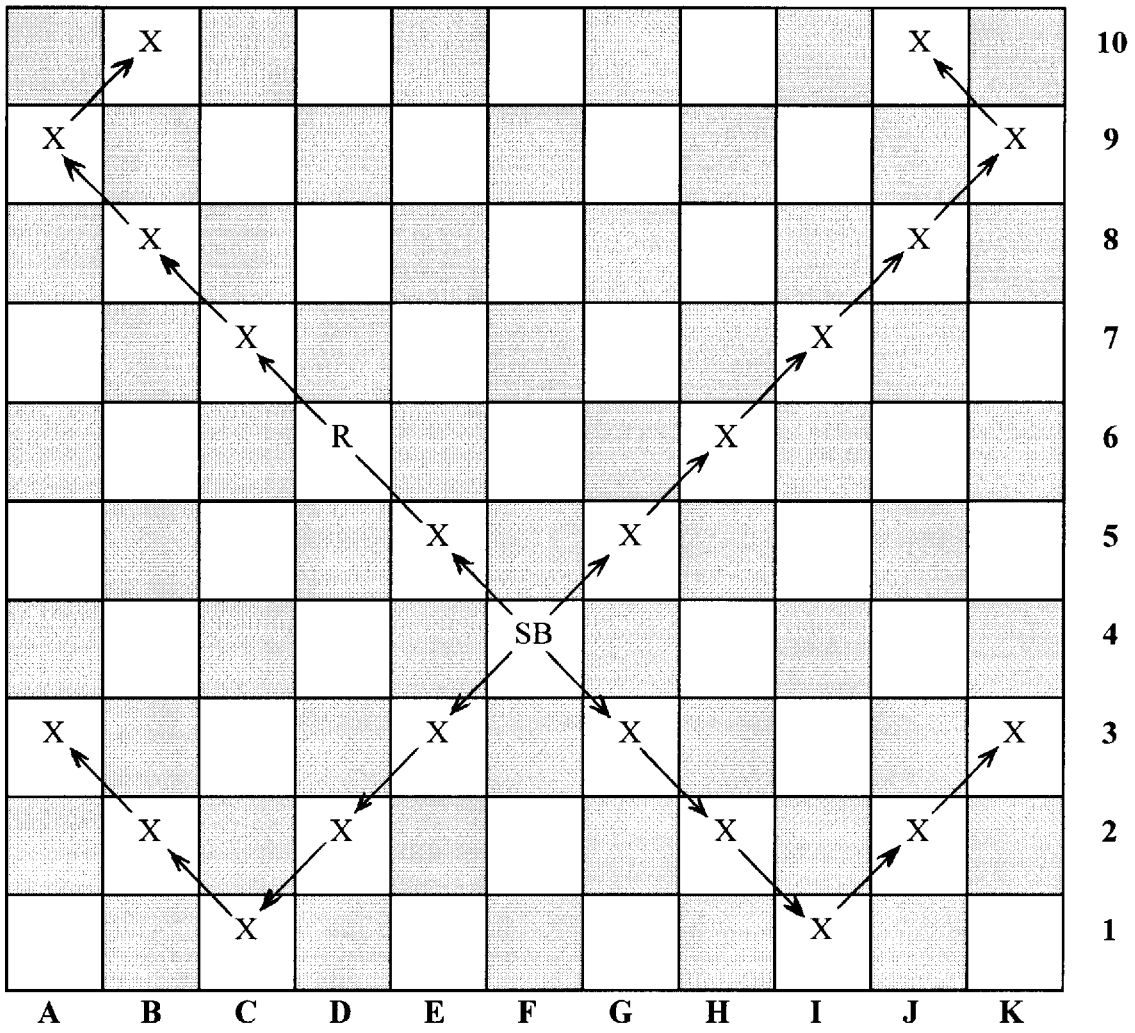
FIG. 8 is a representation of the movement pattern of the super bishop upon a portion of the expanded game board also demonstrating the jumping movement of said piece over another piece.

As seen in FIG. 8, the super bishop has the same movement as the orthodox bishop with the exception that the super bishop may jump all of its own pieces except the super king.

As seen in FIG. 8, said super bishop may ricochet off the side of the board and continue its move following the same diagonal until it stops voluntarily, or it takes a piece or it reaches another side.

As seen in FIG. 1, each color is provided with a super king. The white side has said super king initially located at F1. The black side has said super king initially located at F10.

Figure 2:
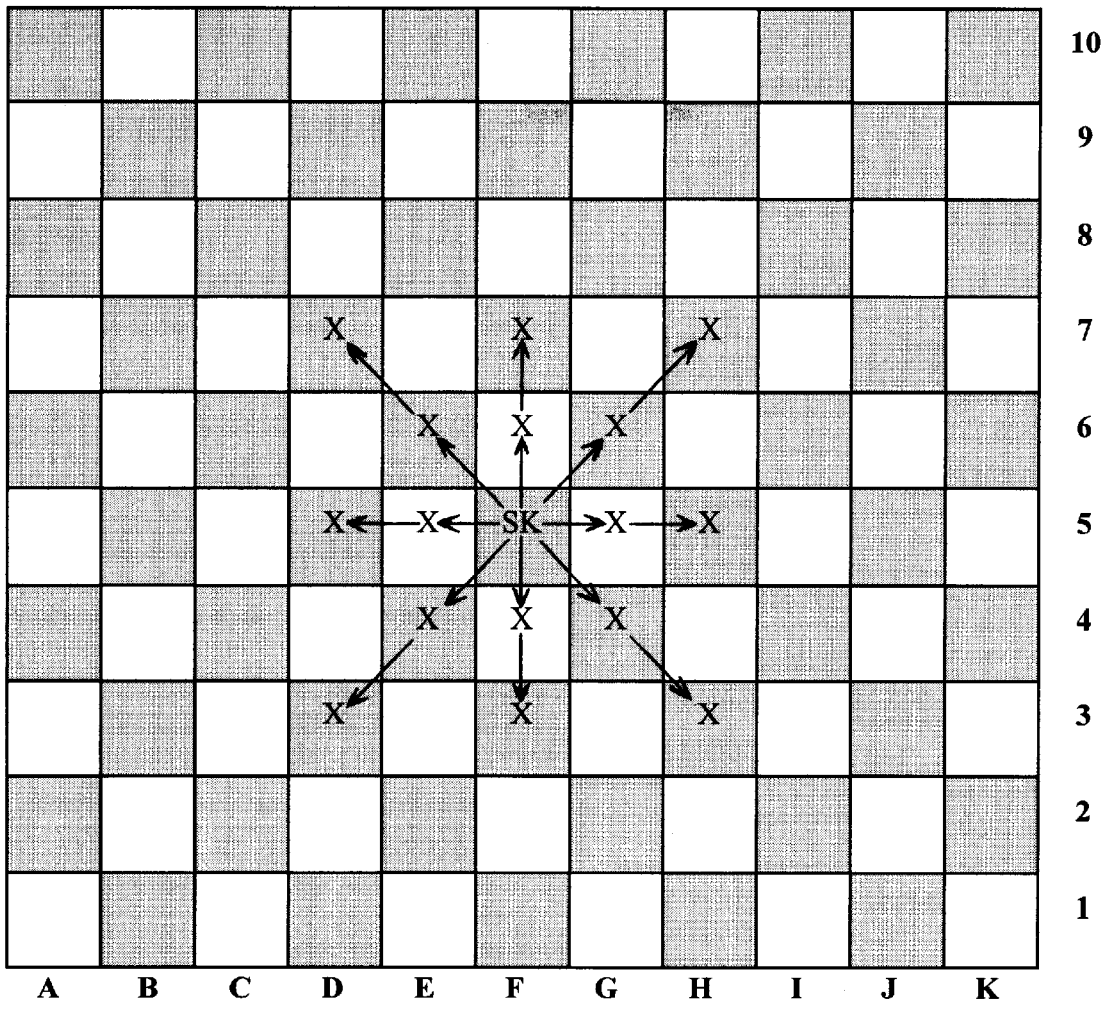
FIG. 2 is a representation of the movement pattern of the super king upon a portion of the expanded chess game board.

As seen in FIG. 2, the super king can move one or two squares in either horizontal, vertical, or diagonal direction it cannot jump pieces and it can only move one square while in check. Said super king may not move into check.

As seen in FIG. 1, each color is provided with one super queen. The white side has said super queen initially located at E1. The black side has said super queen initially located at E10.

Figure 6:
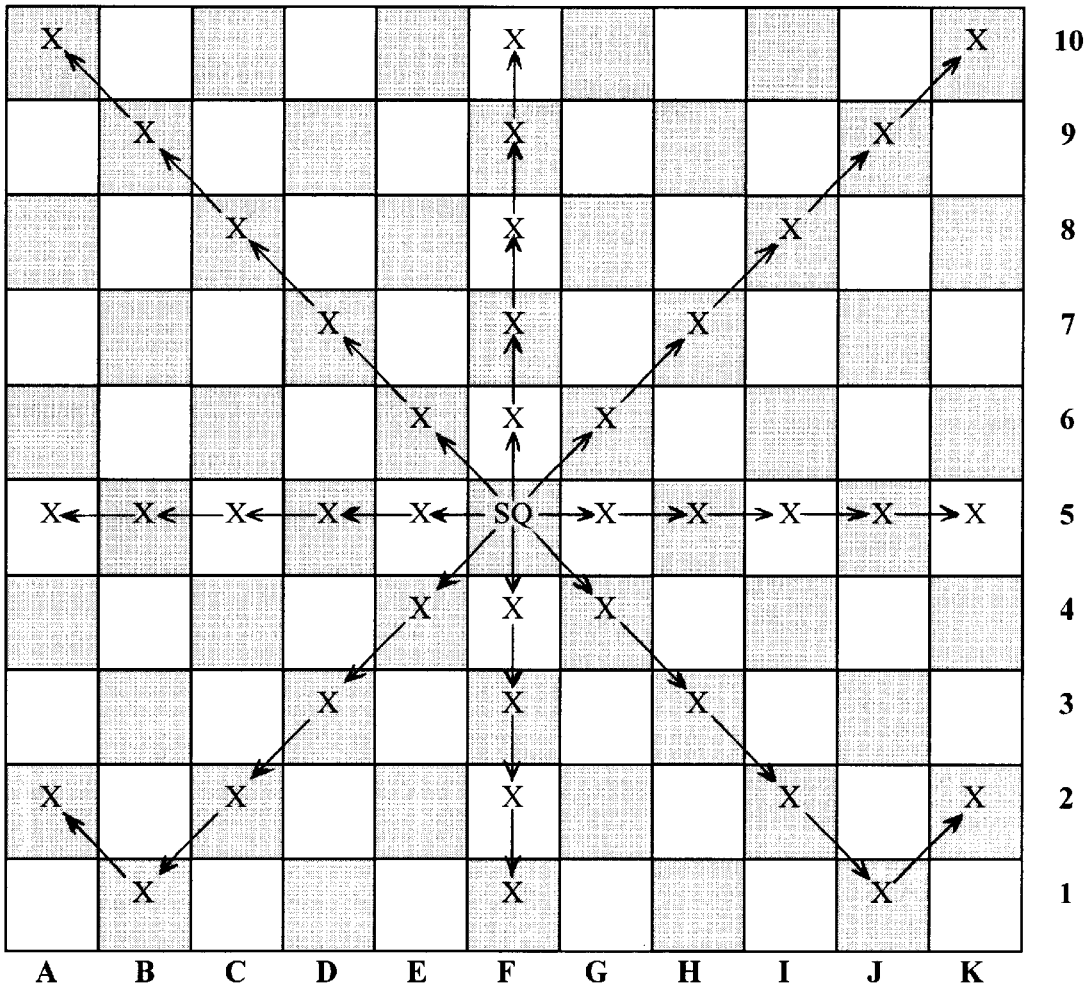
FIG. 6 is a representation of the movement pattern of the super queen upon a portion of the expanded chess game board.

As seen in FIG. 6, the super queen has the combined movement of the super rook and the super bishop.

As seen in FIG. 1, each color is provided with one monster piece. The white side has said monster piece initially located on G1. The black side has said monster piece initially located at G10.

Figure 3:
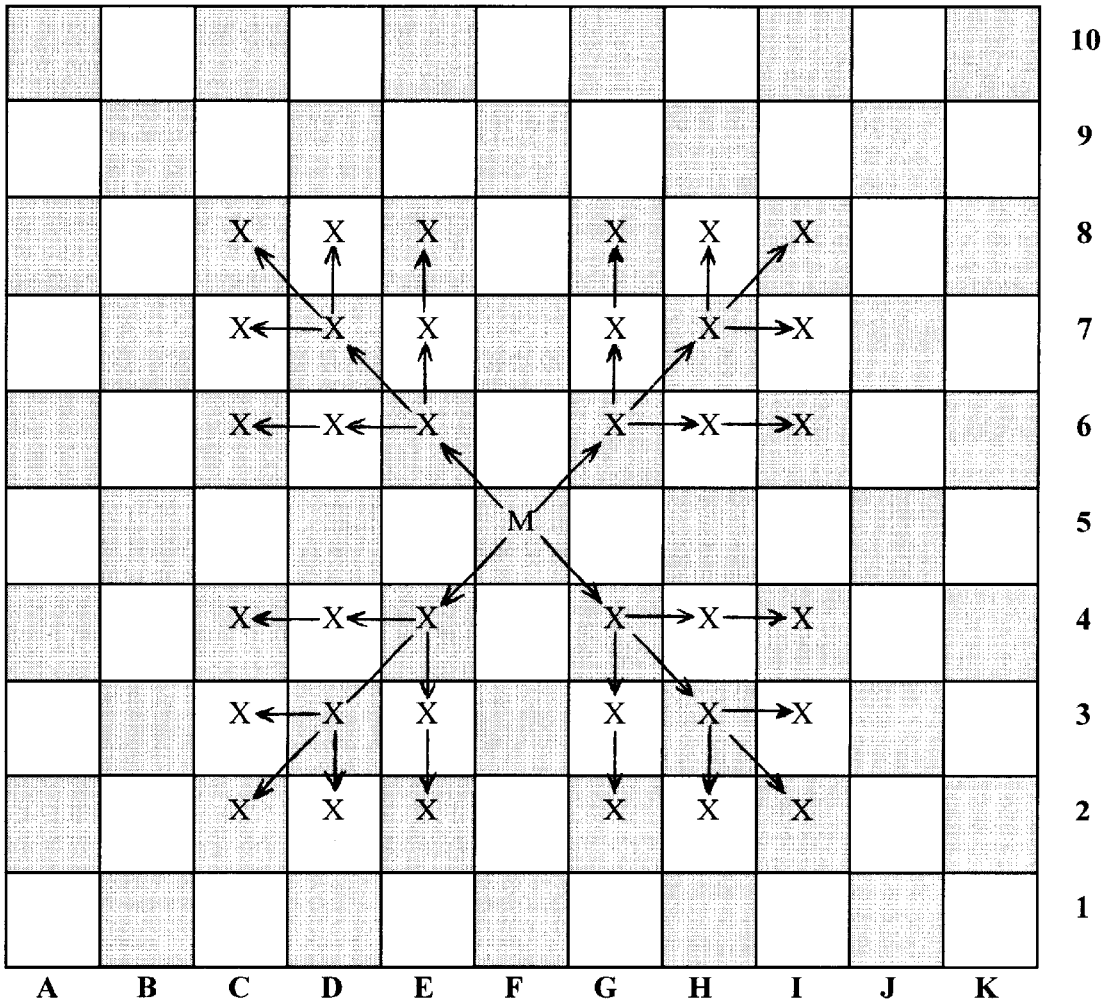
FIG. 3 is a representation of the movement pattern of the monster piece upon a portion of the expanded game board.

As seen in FIG. 3, the monster piece can move to any square in four square sets of three squares by three squares comprising four sets of nine squares each set of nine squares being directly diagonal to said monster piece.

Figure 4:
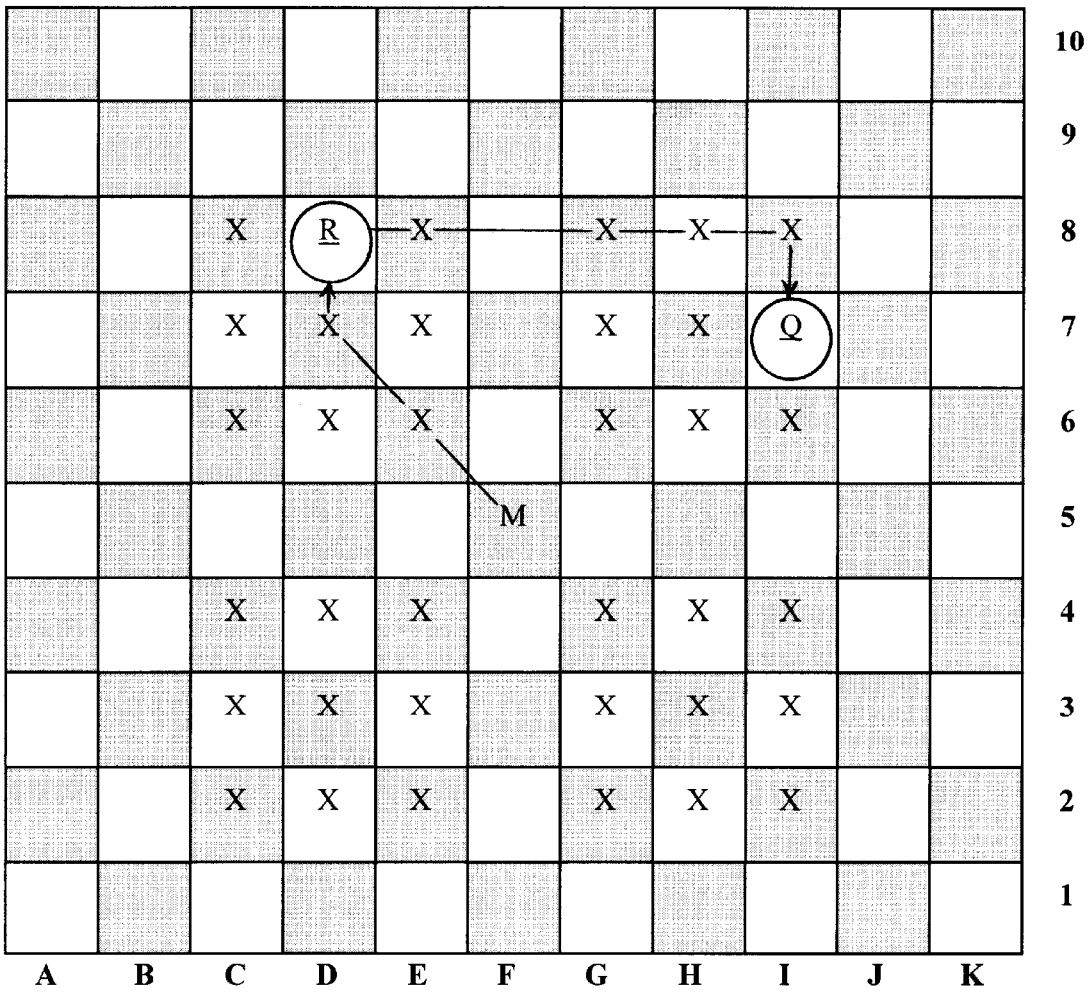
FIG. 4 is a demonstration of the monster piece taking two pieces in one move.

As seen in FIG. 4, the monster piece may take any two pieces that are within its field of movement in one move, and may also jump any piece.

As seen in FIG. 1, each color is provided with two phantom pieces. The white side includes two phantom pieces initially located on the first row at D1 and H1. The black side includes two phantoms initially located on the tenth row at D10 and H10.

Figure 5:
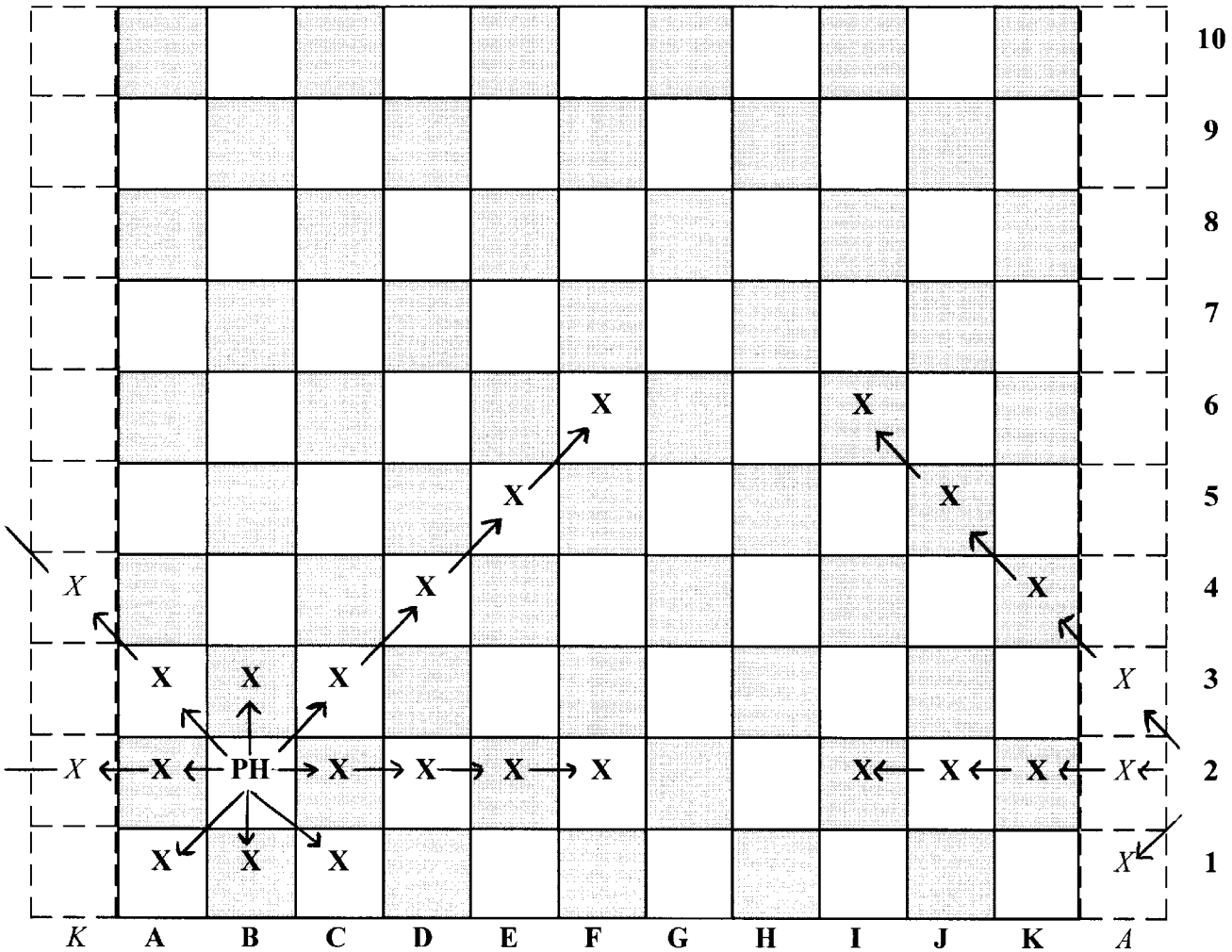
FIG. 5 is a representation of the movement pattern of the phantom piece upon a portion of the expanded game board.

As seen in FIG. 5, the phantom piece can move one, two, three or four squares in either horizontal, vertical or diagonal directions.

As demonstrated in FIG. 21, the phantom piece can jump any piece on the board when making its move.

As seen in FIG. 5, the phantom piece has the very unique ability of moving off the left side or the right side of the board and can come back on the opposite side completing said pieces move, but the phantom piece cannot move off or come back on the top or bottom of the playing board.

The previous described version of the present invention has many advantages, including a primary advantage of providing a novel method of playing a modified chess game with eight novel pieces providing new and interesting moves resulting in more complex and entertaining play.

Another advantage of the present invention is to provide a novel method of playing a modified chess game having a modified playing field consisting of eleven columns by ten rows. Such an eleven by ten playing board results in a greater percentage of open area and consequently a greater number of opening move sequences.

A still further advantage of the present invention is to provide a novel method of playing a modified chess game wherein new pieces, the monster, phantom, super queen, super bishop, and super knight result in the introduction of many new, entertaining and complex forking strategies.

The invention resides not in any one of these features per se, but rather in the particular combinations of all of them herein disclosed and claimed and it is distinguished from the prior art in this particular combination of all of its structures for the functions specified.

Although the present invention has been described in considerable detail and with reference to certain preferred versions other versions are possible. For example while in a preferred embodiment of the invention, the lower right corner of the board is white, it could alternatively be black. Similarly in other versions of the game the pieces could be set up differently by arranging the pieces in the second and ninth rows or the first and tenth rows differently to begin the game. Also, while in a preferred version of the invention castling results in the king moving four squares toward the super rook in an alternate version of the invention the super king may move one, two, or three squares. Also, folding boards, sectional boards, and the like may be used. And still further the game could be played without the orthodox pieces by setting the pieces up with only two rows for white at row one and row two and two rows for black set up at row nine and row ten utilizing only the super pieces the game would have the same set up of pieces on the first row and the tenth row but the second and ninth rows would have eleven super pawns one for each square of row two and one for each square of row nine, and the super pawns would have one new rule they could only move one, two, or three moves on the first move. And the advanced chess game described herein might also be played utilizing a computer screen, without any change in the moving and capturing power of the pieces, a transient image upon the screen replacing the traditional permanently embodied playing boards. Therefore, the spirit and scope of the appended claims should not be limited to the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of playing a modified chess game by a first player against a second player, comprising the steps of:

(A) providing a game board consisting of ten horizontal rows and eleven vertical columns of squares having alternating light and dark colors;

(B) providing a plurality of playing pieces, including one set of light-colored pieces for the first player, a second set of dark colored pieces for the second player, each set comprises eighteen orthodox pieces: eleven pawns, two rooks, two knights, two bishops, one queen, and fifteen new and unique super pieces: four super pawns, two super rooks, two super knights, two super bishops, one super queen, one super king, two phantoms, one monster;

(C) initially positioning the set of light-colored pieces at the start of the game, in the first row of 11 squares at the first end of the game board from left to right in the sequence super rook, super bishop, super knight, phantom, super queen, super king, monster, phantom, super bishop, super knight, super rook, with the second row sequence being super pawn, super pawn, rook, bishop, knight, queen, bishop, knight, rook, super pawn, super pawn, with the initial positioning of the third row being one orthodox pawn in each of the eleven squares;

(D) initially positioning the set of dark colored pieces in the tenth row of eleven squares at the opposing end of the game board, from left to right in the sequence super rook, super bishop, super knight, phantom, super queen, super king, monster, phantom, super bishop, super knight, super rook, with the pieces in the ninth row initially positioned super pawn, super pawn, rook, bishop, knight, queen, bishop, knight, rook, super pawn, super pawn, with the initial positioning of the eight row being one orthodox pawn in each of the eleven squares;

(E) formatting rules of movement for play wherein each of the orthodox pieces has the same rule of movement as in orthodox chess;

(F) formatting rules of movement wherein each orthodox pawn cannot promote to anything except an orthodox piece;

(G) formatting rules of movement wherein each orthodox pawn can only use the en passant move against an orthodox pawn.

2. The method of playing a modified chess game of claim 1, further comprising the movements of new pieces:

(A) formatting rules of movement for play of the super king wherein the same rules apply as to the orthodox king with the exception that the super king can move one or two squares in either horizontal, diagnol or vertical directions;

(B) formatting rules of movement of play of the super king wherein said piece may only move one square when in check;

(C) formatting rules of movement for play wherein the super pawn can take by en passant anytime another super pawn passes it without giving said super pawn an opportunity to exchange;

(D) formatting rules of movement for play wherein each super rook has the same rules of movement as orthodox rooks except the super rook can jump all of its own pieces except the super king;

(E) formatting rules of movement for play wherein each super night has the same movement as an orthodox night but additionally has the ability to move to a square three squares in either horizontal direction and two squares in either vertical direction. And said super night may also move to a square three squares in either vertical direction and two squares in either horizontal direction;

(F) formatting rules of movement for play wherein each super bishop has the same movement as the orthodox bishop except that it may jump its own pieces and can ricochet once off any side and continue its move;

(G) formatting rules of movement for play wherein the super bishop while making a ricochet move puts the opposing super king in check must stop where said super bishop changes direction while landing on the side square;

(H) formatting rules of movement for play wherein the super queen has the combined movement of the super bishop and the super rook;

(I) formatting rules of movement for play wherein the monster piece can move to any square in a four square set of three squares by three squares comprising four sets of nine squares each set of nine squares being directly diagonal to a said monster piece;

(J) formatting rules of movement for play wherein the monster piece can on one move take two pieces that are within any of four three by three groups of squares in said monster pieces field of movement;

(K) formatting rules of movement for play wherein the monster piece can jump any piece on the board while making a move;

(L) formatting rules of movement for play wherein the super rook, super bishop, and super queen cannot jump the super king;

(M) formatting the rules of movement for play wherein each phantom piece can move one, two, three or four squares horizontally, vertically, or diagonally;

(N) formatting the rules of movement for play wherein each phantom piece can jump any piece while making a move;

(O) formatting the rules of movement for play wherein the phantom piece can move off the left side of the board horizontally or diagonally and enter on the right side of the board to finish its move in the direction it was traveling;

(P) formatting the rules of movement for play wherein each phantom piece can move off the right side of the board horizontally or diagonally and enter on the left side of the board to finish its move in the direction it was traveling.

* * * * *